US007340067B2

(12) United States Patent
Murase et al.

(10) Patent No.: US 7,340,067 B2
(45) Date of Patent: Mar. 4, 2008

(54) WAVE SIGNAL PROCESSING SYSTEM AND METHOD

(75) Inventors: Kentaro Murase, Kawasaki (JP); Takuya Noda, Kawasaki (JP); Kazuhiro Watanabe, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 770 days.

(21) Appl. No.: 10/347,321

(22) Filed: Jan. 21, 2003

(65) Prior Publication Data

US 2003/0223591 A1 Dec. 4, 2003

(30) Foreign Application Priority Data

May 29, 2002 (JP) ..... 2002-156265

(51) Int. Cl.
*H04R 3/00* (2006.01)

(52) U.S. Cl. ..... 381/92

(58) Field of Classification Search ..... 381/122, 381/91–92, 94.1–94.3, 71.1–71.3
See application file for complete search history.

(56) References Cited

U.S. PATENT DOCUMENTS 5,586,191 A * 12/1996 Elko et al. ..... 381/92
6,041,127 A * 3/2000 Elko ..... 381/92
6,449,586 B1 * 9/2002 Hoshuyama ..... 702/190
6,774,934 B1 * 8/2004 Belt et al. ..... 348/211.1
2001/0028720 A1 * 10/2001 Hou ..... 381/92
2003/0031328 A1 * 2/2003 Elko et al. ..... 381/92

FOREIGN PATENT DOCUMENTS

JP 9-22327 A 1/1997
JP 2002-78697 3/2002

* cited by examiner

*Primary Examiner*—Vivian Chin
*Assistant Examiner*—Lun-See Lao
(74) *Attorney, Agent, or Firm*—Staas & Halsey LLP

(57) ABSTRACT

The present invention provides wave signal processing systems and methods that estimate a wave source direction and use that information to realize sharp directivity even in the case of a device that is compact or that has limited calculating capacity. A wave signal processing system of the present invention is provided with at least one sensor group made of at least two sensors, determines a difference signal between wave signals detected by any two sensors in at least one of the sensor groups and determines a differential signal of a wave signal detected by at least one sensor, and based on a combination of a sign of the difference signal and a sign of the differential signal and a positional relationship of the sensors, determines the sign of a delay time between the wave signals that are detected by the two sensors and determines the direction of the wave source based on whether the sign of the delay time is positive or negative.

12 Claims, 13 Drawing Sheets

WAVE SIGNAL PROCESSING SYSTEM AND METHOD

FIELD OF THE INVENTION

The present invention relates to a wave signal processing system and method that detects the direction of a wave source that generates wave signals, especially a sound wave, which are propagated through a medium, and achieves sharp directivity using a compact system and a small number of operations. It should be noted that "medium" is used in a broad sense to include material media, voids, and fields, for example, through which wave signals are propagated.

BACKGROUND OF THE INVENTION

A characteristic of wave signals is that they travel through a particular medium radially from a wave source. For sound waves, which are a type of wave signal, for example, unidirectional microphones having maximum sensitivity in the forward direction and gun microphones having sharp directivity, have been developed as devices for detecting sound waves from a specific direction.

Well known methods in which a plurality of microphones are used include microphone array technologies and a method for creating directivity in a target direction by suppressing wave signals arriving other than from a target direction by detecting the direction of the wave source. When such approaches are adopted, unidirectivity can be established in any direction by arranging three or more microphones in such a way that they do not form a straight line.

If a plurality of microphones are used to detect the direction of a wave source, then it is necessary to calculate the time difference of the signals arriving at each microphone, and correlation calculation is generally used for this calculation. Alternatively, instead of correlation calculation, Japanese Patent Application No. 2002-078697 discloses a method in which few operations are used to calculate the time difference between wave signals that arrive at each microphone using difference signals and differential signals of the received signals.

However, a general problem with cardioid-type unidirectional microphones has been that although there is significant suppression of wave signals from the rear, there is little suppression of wave signals from the sides, and thus only broad directivity has been possible. On the other hand, although gun microphones have sharp directivity, the fact that a large sound tube must be provided in the direction of the wave source means that they require a larger set up space than general microphones and thus are not easily incorporated into compact devices. Similarly, microphone arrays require a large aperture in order to achieve sharp directivity, and thus require a larger set up space than general microphones, which has made it difficult to incorporate them into compact devices.

In addition, with the method using a plurality of microphones to detect the direction of a sound source and thereby create directivity, it is necessary to convert the analog input signals into digital signals at a high sampling rate and then perform correlation calculation, which requires a large number of operations for a large volume of sampled data. Accordingly, such methods are not easily adopted in real time applications and are also not easily achieved with processors having limited computing power.

Furthermore, incorporating microphones into compact devices results in a narrow aperture and very short delay times, and thus there is the problem that it is difficult to precisely calculate the delay time with methods using correlation calculation.

To solve the foregoing problems, it is an object of the present invention to provide a wave signal processing system and method with which processing is carried out using a small aperture and with which sharp directivity can be realized using few operations, as a method for detecting the direction of a wave source that is necessary when directivity is created using a plurality of microphones.

SUMMARY OF THE INVENTION

In order to achieve the above object, a wave signal processing system according to the present invention including at least one sensor group made of at least two sensors comprises a difference signal calculating unit for calculating a difference signal between wave signals detected by any two sensors in at least one sensor group, a differential signal calculating unit for calculating a differential signal of a wave signal detected by at least one sensor, and a delay time sign determining unit for determining a sign of a delay time between the wave signals that are detected by the two sensors based on a combination of a sign of the difference signal and the differential signal and a positional relationship of the sensors.

With this configuration, the sign of the delay time can be determined simply by comparing the signs of the difference signal and the differential signal, and thus processing can be completed with a small number of operations and accurate signal processing can be carried out stably, particularly in the case of sensor arrangements with small apertures capable of detecting only very small delay times.

Further, the wave signal processing system according to the present invention preferably further comprises a wave source direction determining unit for determining a direction of a wave source based on the positive or negative sign of the delay time between the wave signals detected by at least one sensor group that is determined by the delay time sign determining unit and the positional relationship of the sensors. Consequently, the direction of the wave source can be determined simply by comparing the signs of the difference signal and the differential signal, and thus the wave source can be determined with a small number of operations and the wave source direction can be accurately and stably specified, particularly in the case of sensor arrangements with small apertures capable of detecting only infinitesimal delay times.

Further, the wave signal processing system according to the present invention preferably further comprises a weight coefficient calculating unit for calculating a weight coefficient based on the positive or negative sign of the delay time between the wave signals detected by at least one sensor group that is determined by the delay time sign determining unit and the positional relationship of the sensors, or the wave source direction of the wave signal detected by at least one sensor group that is determined by the wave source direction determining unit. This is because the weight coefficient that is employed in suppressing noise, which is described later, can be calculated with few operations.

Additionally, the wave signal processing system according to the present invention preferably further comprises a signal suppressing unit that uses the weight coefficient to weight the wave signals detected by at least one sensor in order to suppress unnecessary wave signal components that arrive from other than the target wave source direction. This is because directivity can be created with few operations by suppressing noise signals.

Further, the wave signal processing system according to the present invention is preferably provided with at least two sensor groups each made of at least two sensors, comprises a delay time calculating unit for calculating the delay time of any two sensor signals of at least one sensor group, and performs wave signal processing based on the delay time sign in parallel. Also, the wave signal processing system according to the present invention preferably further comprises a wave source direction calculating unit for calculating a direction of the wave source based on the calculated delay time. By using this system together with conventional methods, processing can be carried out with compact devices and with few operations, and the direction of the wave source can be estimated with greater precision.

Also, in the wave signal processing system according to the present invention, the delay time sign determining unit preferably further comprises a signal calculating unit for multiplying or dividing the difference signal and the differential signal, and a signal sign determining unit for determining a sign of the result of multiplying or dividing by the signal calculating unit.

Furthermore, in the wave signal processing system according to the present invention, the delay time sign determining unit preferably further comprises a difference signal sign determination unit for determining the sign of the difference signal, a differential signal sign determining unit for determining the sign of the differential signal, and a sign determining unit for comparing the sign of the difference signal in the difference signal sign determining unit and the sign of the differential signal in the differential signal sign determining unit and determining the delay time sign.

In addition, the wave signal processing system according to the present invention preferably comprises a low-pass filter in a stage after the delay time sign determining unit. This allows the determination of the delay time sign to always yield accurate results, and the sign of the delay time can be determined with greater accuracy, even with a calculating device that is compact or that has limited computing power.

Further, the wave signal processing system according to the present invention preferably comprises a low-pass filter in a stage after the sensor group. Thus, errors in the determined delay time sign caused by high frequency components can be reduced, and the delay time can be determined with increased accuracy, even with a calculating device that is compact or that has limited computing power.

The present invention is also characterized by a recording medium storing software for executing the function of the above-mentioned wave signal processing systems as a process of a computer. More specifically, the present invention is characterized by a recording medium storing computer-executable software for realizing a wave signal processing method and processes thereof The method includes the operations of: using device that is provided with at least one sensor group made of at least two sensors, determining a difference signal between wave signals detected by any two sensors of the sensor groups, determining a differential signal of a wave signal detected by at least one sensor, and determining a sign of a delay time between the wave signals detected by the two sensors based on a combination of a sign of the difference signal and the differential signal and the positional relationship of the sensors. It is also characterized by a computer executable program for realizing these operations.

With this configuration, the program is loaded onto a computer and executed, thereby allowing the delay time sign to be determined simply by comparing the signs of the difference signal and the differential signal. Thus, processing can be completed with a small number of operations, and a wave signal processing system that is capable of stably performing accurate signal processing can be configured, particularly in the case of sensor arrangements with a small aperture capable of calculating only very small delay times.

DETAILED DESCRIPTION OF THE INVENTION

First, the principle of the wave signal processing system according to the present invention is described. It should be noted that the following description is about a wave signal processing system that includes a single sensor group having two sensors, but embodiments of the present invention can have three or more sensors and two or more sensor groups.

Figure 1:
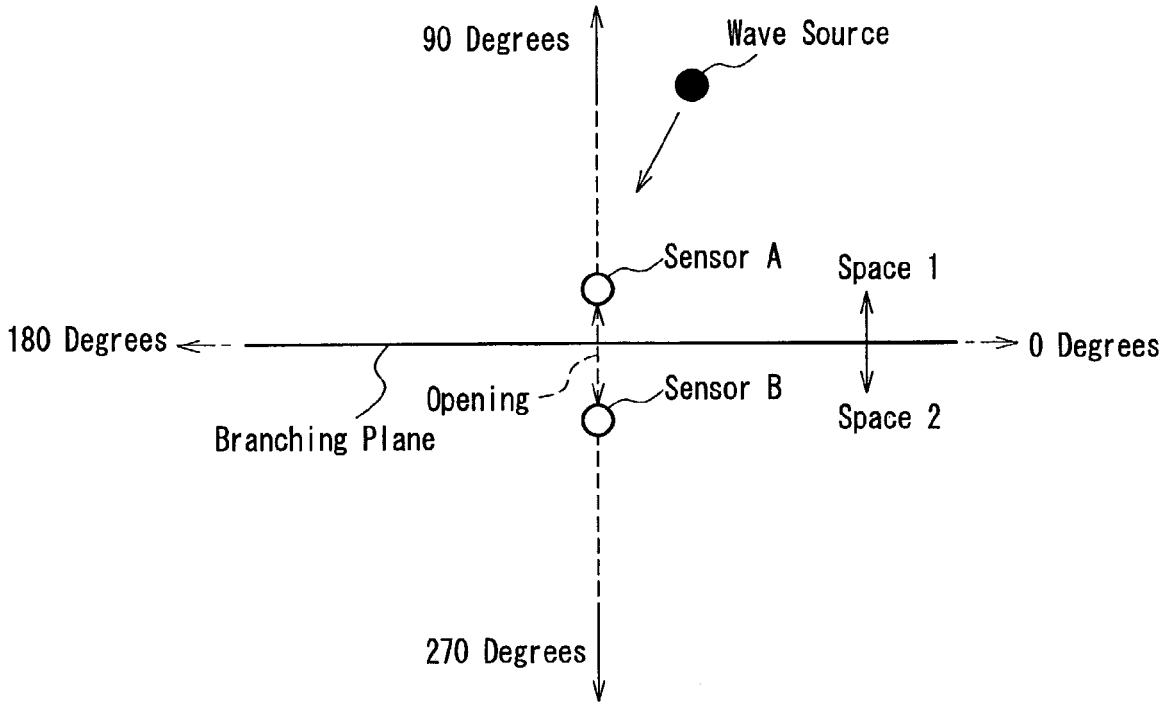
FIG. 1 is a diagram showing the positional relationship between a wave source and a sensor group.

First, FIG. 1 shows the positional relationship of the wave source and the two sensors, sensor A and sensor B. With the positional relationship shown in FIG. 1, the wave signals that are received by the sensor A and the sensor B are given as $f_A(t)$ and $f_B(t)$, respectively.

As is clear from FIG. 1, signals from the wave source reach the sensor A first, and thus the signal $f_B(t)$ is delayed compared to the signal $f_A(t)$. This time delay shall be a delay time Δt. It should be noted that a positive (+) sign for Δt represents a lead time and a negative (−) sign represents a delay time.

In this case, the signal $f_B(t)$ of the sensor B can be expressed using the signal $f_A(t)$ of the sensor A in Equation 1.

$$f_B(t)=f_A(t+\Delta t) \qquad \text{Equation 1}$$

Next, Equation 1 is subjected to Taylor expansion, and when terms including and after the second differential term are omitted under the assumption that the delay time Δt is infinitesimal, then Equation 2 can be obtained as an approximation.

$$f_B(t)=f_A(t+\Delta t)\approx f_A(t)+\Delta t\cdot f'_A(t) \qquad \text{Equation 2}$$

The delay time Δt can be obtained by solving Equation 2. Equation 3 shows the result of determining Δt by Equation 2.

$$\Delta t\approx(f_B(t)-f_A(t))/f'_A(t) \qquad \text{Equation 3}$$

From Equation 3, Δt can be determined as the value of the difference signal $f_B(t)-f_A(t)$ between the two sensors divided by the differential signal $f'_A(t)$.

Next, let us examine the signs of the signals. If there is a time delay (Δt is a negative number), and either the difference signal $f_B(t)-f_A(t)$ or the differential signal $f'_A(t)$ is positive, then the other must be negative. On the other hand, if there is a temporal lead (Δt is a positive number), the signs of the difference signal and the differential signal are both either positive or negative. Table 1 shows the relationship between the sign of the delay time and the sign of the difference and differential signals.

TABLE 1

| lead/delay with respect to sensor A | sign of delay time | difference signal $f_B(t) - f_A(t)$ | differential signal $f'_A(t)$ |
|---|---|---|---|
| Lead | positive | positive | positive |
| Lead | positive | negative | negative |
| Delay | negative | negative | positive |
| Delay | negative | positive | negative |

Consequently, as is clear from Table 1, whether the delay time Δt is positive or negative, that is, whether the signal is leading or delayed, can be determined by checking the combination of the sign of the difference signal and the sign of the differential signal.

Figure 2:
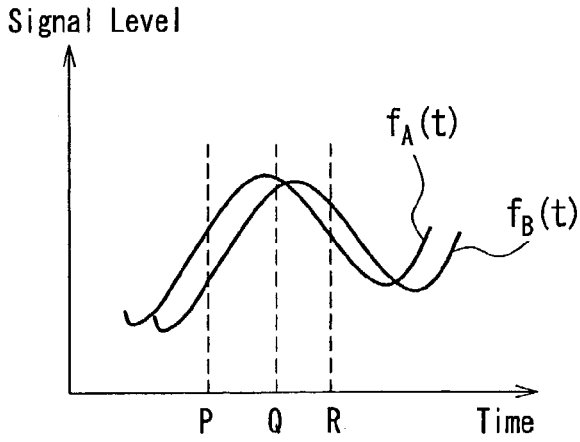
FIG. 2 is a diagram illustrating the wave signal at receiving.

For example, FIG. 2 shows an example in which a wave signal is received with the sensors arranged as in FIG. 1. In FIG. 2, the combination of the signs of the difference signal $f_B(t)-f_A(t)$ and the differential signal $f'_A(t)$ of the sensors at times P, Q, and R is shown in Table 2.

TABLE 2

| time | determined result | difference signal $f_B(t) - f_A(t)$ | differential signal $f'_A(t)$ |
|---|---|---|---|
| P | negative (delayed) | negative | positive |
| Q | positive (leading) | negative | negative |
| R | negative (delayed) | positive | negative |

As can be understood from Table 2, at points P and R, it is possible to accurately determine whether there is a temporal lead or delay by a determination method using the above-mentioned Table 1. However, at point Q, the sign of Δt is reversed, and an incorrect result is obtained. This is due to the effect of the terms including and after the second differential term, which are ignored in Equation 2.

Figure 3:
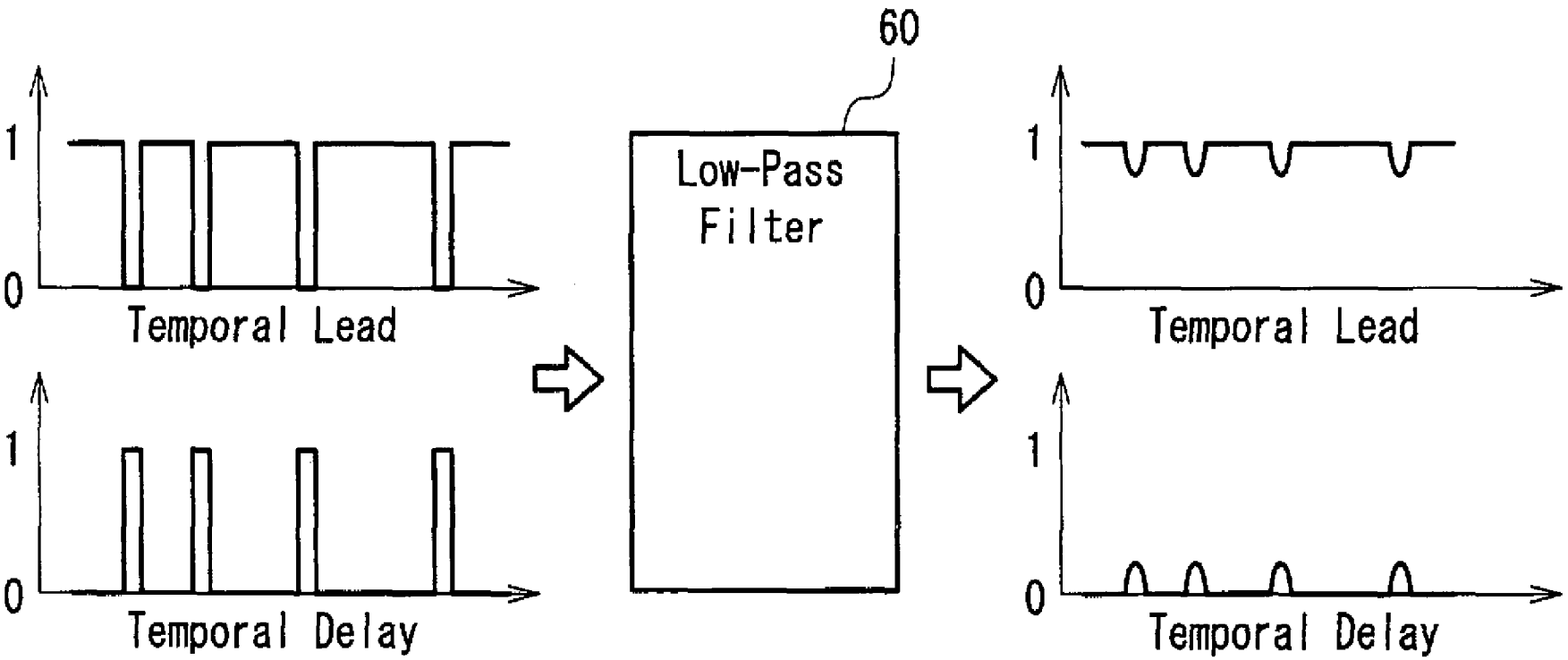
FIG. 3 is a diagram showing corrected results obtained by a low-pass filter.

From FIG. 2 it can be understood that the period during which incorrect results are obtained, like at point Q, lasts for the approximately the period of the delay time Δt after a maximum point or a minimum point of the waveform of sensor A. If the delay time Δt is infinitesimal compared to one wave length of the signal, then the period during which such inaccurate detections are made occurs intermittently only for short periods near the maximum point and near the minimum point of the waveform of the signal. For example, as shown in FIG. 3, the result of the determination of the sign of the delay time can be set to "1" if positive and "0" if negative and output, and this output can be passed through a low pass filter 60. Here, for example, a result greater than 0.5 can be taken as "leading" and less than 0.5 can be determined "delayed."

Thus, in the present invention, whether the delay time Δt is positive or negative, that is, whether there is a temporal lead or delay, can be determined simply by checking the sign of the signal. Consequently, compared to conventional methods, such as methods in which the delay time is calculated through correlation calculation and the sign of the delay time is then extracted, it is not necessary to perform correlation calculation, which requires a large number of operations for the large volume of data that are converted from analog data to digital data at a high sampling rate, and thus the sign of the delay time can be determined using a small number of operations.

Also, using the above-described principle, because the Taylor expansion approximation (Equation 2) is derived under the assumption that the delay time Δt is infinitesimal, accurate results can be obtained more stably than with conventional methods, particularly with sensor arrangements having a small aperture with which only very short delay times can be detected.

Furthermore, the difference calculations, the differential calculations, and the calculations for comparing the sign of the signals that are used in the present invention can be achieved using a difference circuit, a differential circuit, and a comparator, respectively, configured by operational amplifiers. Compared to conventional methods that for correlation calculation require an expensive A/D conversion chip with a high sampling rate and a general purpose processor or a DSP, the present invention is superior not only in terms of cost but also in terms of the simplicity of the system configuration.

The present invention is characterized in that the direction of a wave source is determined based on whether the sign of the delay time in at least one sensor group is positive or negative. As mentioned above, if the sign of the delay time is negative in the sensor arrangement shown in FIG. 1, then this indicates that the wave source is on the sensor A side (space from 0 to 180 degrees) of the perpendicular surface of the two sensors, that is, the plane (hereinafter, referred to as "branching plane") that is perpendicular to the straight line that joins the sensor A and the sensor B and passes through the center of the two sensors (if the delay time is 0, then the wave source is on the branching plane). Consequently, by checking whether the delay time is positive or negative, the direction of the wave source can be determined to either space of the branching plane.

Moreover, with the present invention, by suppressing sound that arrives from the rear plane of the branching plane as noise, directivity can be given to only the front of the branching plane, in contrast to conventional cardioid-type unidirectional microphones, which have directivity also in the rear plane direction.

Figure 4:
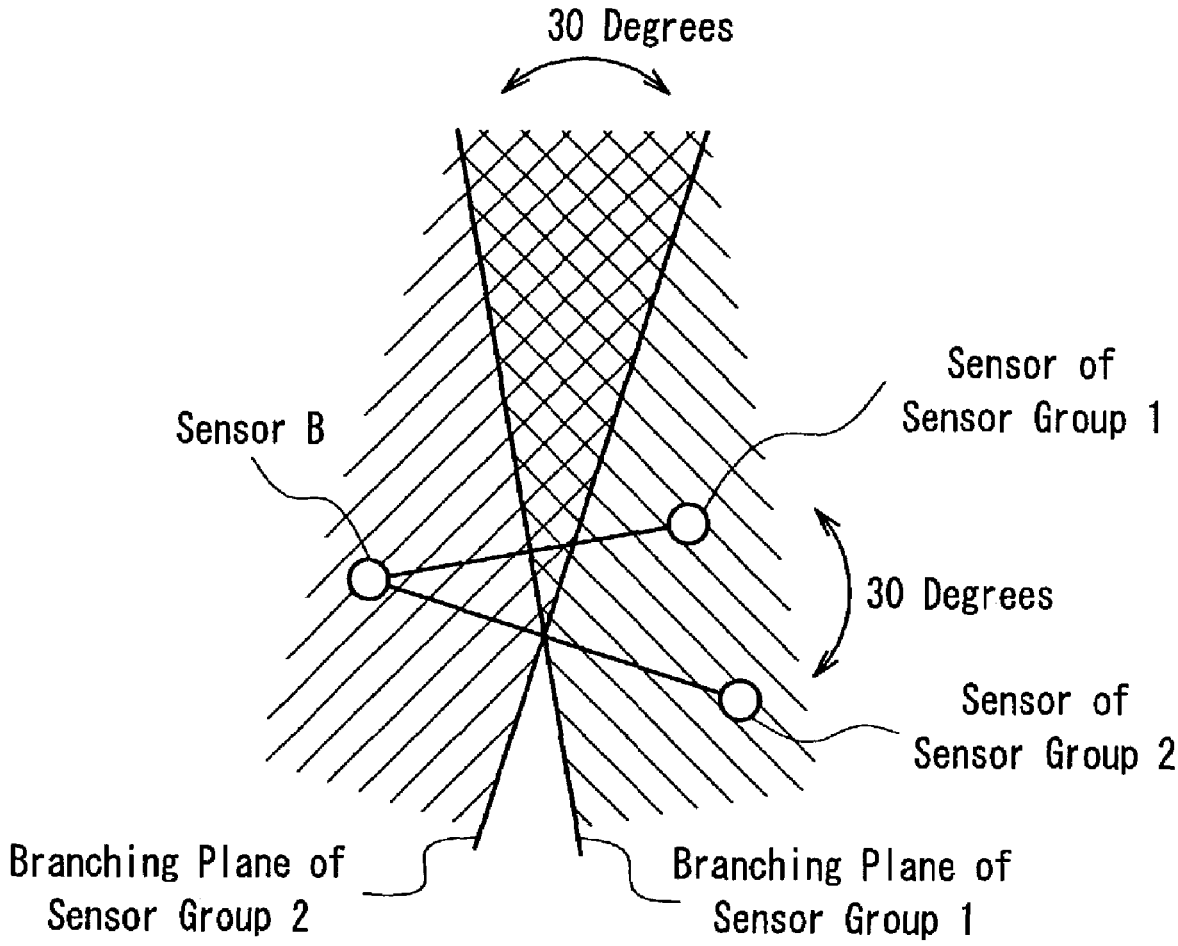
FIG. 4 is a diagram showing the positional relationship between the wave source and the sensor groups where there is a plurality of sensor groups.

Also, if as shown in FIG. 4 three sensors are arranged so that they define an angle of 30 degrees, then when the determined results of the sensor group 1 indicate the space on the right side of the branching plane of the sensor group 1 and the determined results of the sensor group 2 indicate the space on the left side of the branching plane of the sensor group 2, the position of the wave source can be specified in the forward 30 degree space illustrated by the cross-hatching in FIG. 4, which is the area of overlap between the two spaces. Thus, by adjusting the arrangement of two sensor groups made of at least three sensors, the direction of a previously set wave source can be determined with precision in a desired angular range.

On the other hand, the direction of a sound source can be similarly determined using only one sensor group made of two sensors if conventional correlation calculation is employed. However, the processing amount in correlation calculation is greater than that of the method of the present invention. That is, although two sensor groups are used in the present invention, the difference signals can be determined for each sensor group and the signal of the sensor B can be also used for the differential signal, so that the range of the sound source direction can be determined simply by carrying out the subtraction with two sensor groups, carrying out the differential calculation with a single sensor, and lastly comparing the signs of the delay times with the two sensor groups.

On the other hand, although with conventional methods the correlation calculations are performed with only one sensor group, it is necessary to calculate the convolution integral for a large volume of input data that are converted from analog data to digital data at a high sampling rate, and thus the number of operations that are made using the present invention is smaller even if the sign of the delay time is determined using two sensor groups.

Furthermore, with the present invention, if the range of the wave source direction that is determined with the above method and the target wave source direction do not match, then received signals can be suppressed to maintain directivity. Consequently, sharp directivity like that seen with conventional gun microphones and microphone arrays can be achieved using three or more sensors, even if there is a smaller aperture than with gun microphones or microphone arrays.

In general, in order to detect any sound source direction and achieve unidirectivity in any direction in a plane identical to the plane on which the sensors are arranged, it is necessary to combine two or more sensor groups. Accordingly, by adopting a conventional sound source direction detection method using correlation calculation for one of the two sensor groups and adopting the method of the present invention in which the sound source direction is determined from the sign of the delay time for the other sensor group, the number of operations can be reduced compared to the case that a conventional sound source direction detection method using correlation calculation is adopted for both sensor groups, and it is possible to detect the sound source from any direction on the plane on which the sensors are arranged and based on these results to achieve unidirectivity.

Hereinafter, wave signal processing systems according to embodiments of the present invention are described with reference to the drawings.

Embodiment 1

Figure 5:
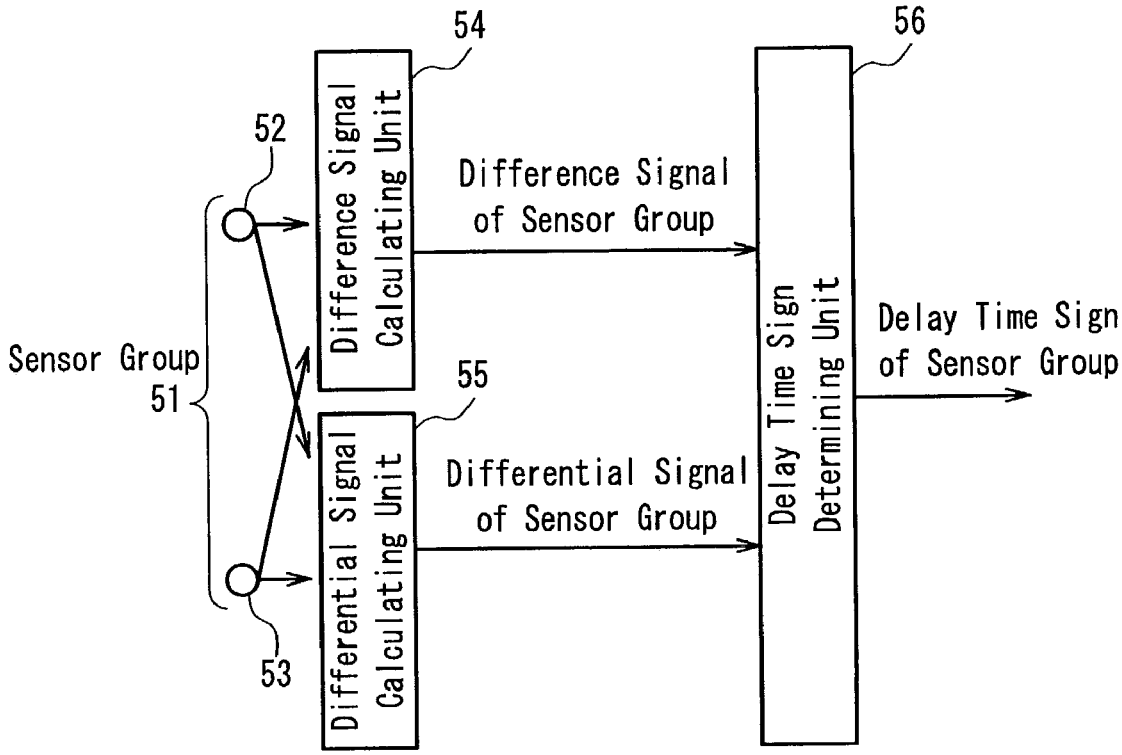
FIG. 5 is a block diagram showing a configuration of the wave signal processing system of an Embodiment 1 according to the present invention.
Figure 6:
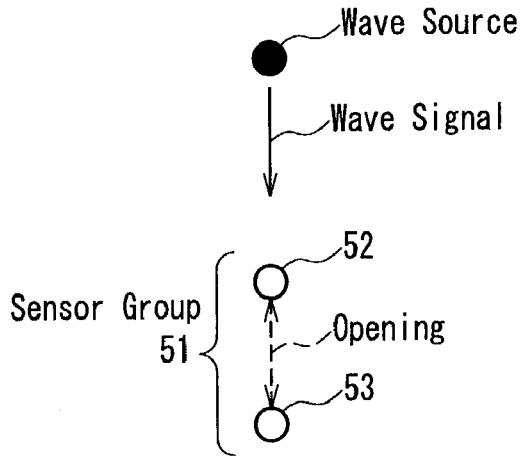
FIG. 6 is a diagram showing the sensor arrangement in the wave signal processing system of an Embodiment 1 according to the present invention.

FIG. 5 is a block diagram showing a configuration of the wave signal processing system of an Embodiment 1 according to present invention. In Embodiment 1, a single sensor group 51, which is shown in the sensor arrangement diagram of FIG. 6, is provided. The sensor group 51 includes two sensors 52 and 53, each of which is capable of converting wave signals into electrical signals and outputting them.

A difference signal calculating unit 54 subtracts the wave signal that is detected by one of the sensors 52 or 53 from the wave signal that is detected by the other sensor 53 or 52 of the sensor group 51, and outputs the difference signal.

A differential signal calculating unit 55 calculates a differential signal for a wave signal detected by at least one of the sensors 52 or 53 in the sensor group 51, and outputs the result.

A delay time sign determining unit 56 outputs the sign of the delay time of the sensor group 51 based on the combination of the sign of the difference signal of the sensor group 51 that is calculated by the difference signal calculating unit 54 and the sign of the differential signal that is calculated by the differential signal calculating unit 55 and the positional relationship of the sensors. It should be noted that the sign of the delay time is determined by comparing the sign of the difference signal and the sign of the differential signal that are looked up from the criteria shown in Table 1.

With the above-described configuration, the sign of the delay time can be determined simply by comparing the sign of the difference signal and the sign of the differential signal, and thus processing can be completed with fewer operations than with conventional methods in which correlation calculation is used to calculate the delay time and the sign of the delay time is extracted.

Also, from the fact that a Taylor expansion approximation (Equation 2) is used under the assumption that the delay time $\Delta t$ is infinitesimal, accurate results can be obtained more stably than with a method in which conventional correlation calculation is carried out to determine the sign of the delay time, even in the case of a sensor arrangement with a small aperture capable of detecting only a very small delay time.

Furthermore, the difference calculations, the differential calculations, and the comparison of the signs of the signals can be achieved by using a difference circuit, a differential circuit, and a comparator, respectively, configured by operational amplifiers. Compared to conventional methods that for correlation calculation require an expensive A/D conversion chip with a high sampling rate and a general purpose processor or a DSP, the present invention is conceivably superior not only in terms of cost but also in terms of the simplicity of the system configuration.

It should be noted that in Embodiment 1 there is only one sensor group 51, however, the number of sensor groups is not limited to one group, and there can be two or more groups. In this case, the sensor groups are arranged so that their apertures intersect one another. Furthermore, the sensor group 51 can be made of three or more sensors.

Figure 7:
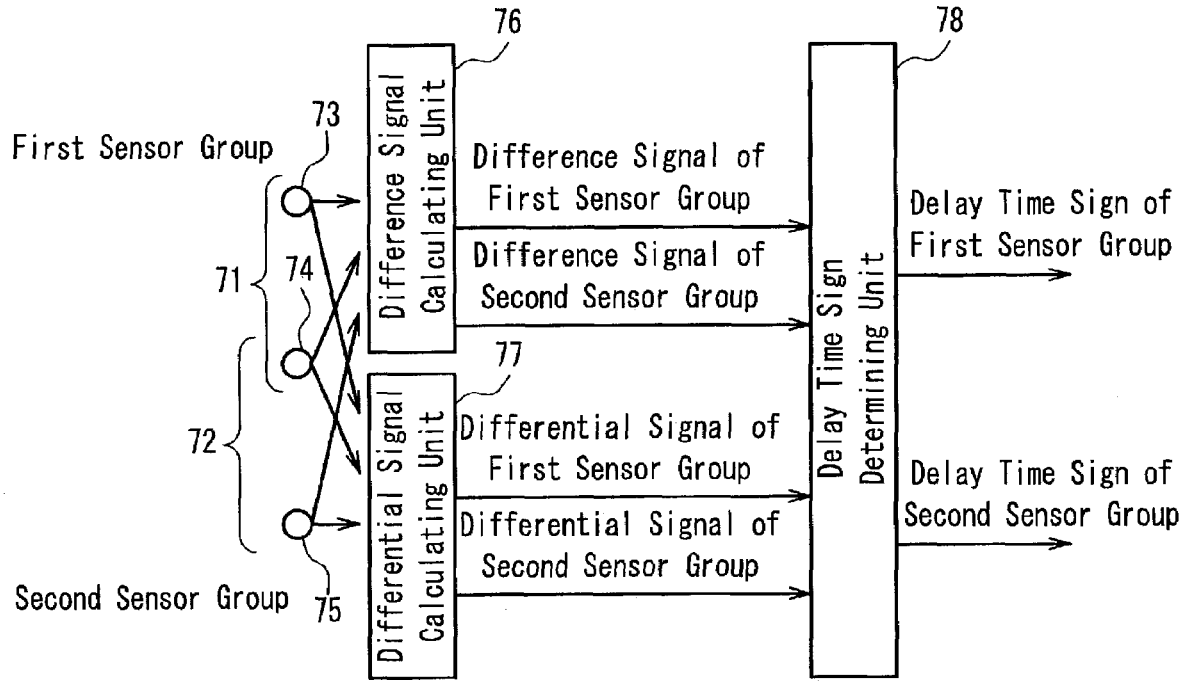
FIG. 7 is a block diagram illustrating the configuration of the wave signal processing system of the Embodiment 1 according to the present invention in a case where there is a plurality of sensor groups.
Figure 8:
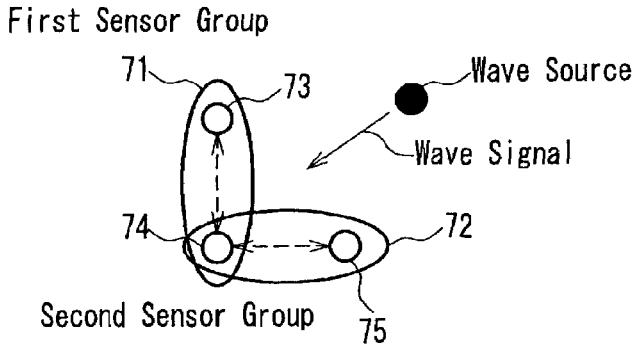
FIG. 8 is a diagram showing the sensor arrangement in the wave signal processing system of an Embodiment 1 according to the present invention in a case where there is a plurality of sensor groups.

As one example, FIG. 7 shows a block diagram in which there are two sensor groups. In FIG. 7, there are two sensor groups 71 and 72, where the sensor group 71 is made of two sensors 73 and 74 and the sensor group 72 is made of two sensors 74 and 75. The two sensors groups are arranged so that their apertures are perpendicular, as shown in FIG. 8, and the sensor 74 is common to the sensor group 71 and the sensor group 72.

In this case as well, each sensor converts wave signals into electrical signals and outputs them. A difference signal calculating unit 76 subtracts the wave signal that is detected by one of the sensors of each sensor group 71 and 72 from the wave signal that is detected by the other sensor of that sensor group, and outputs the difference signal of the first sensor group 71 and the difference signal of the second sensor group 72.

Moreover, a differential signal calculating unit 77 calculates a differential signal of the wave signal detected by at least one sensor in each sensor group 71 and 72, and outputs the differential signal of the first sensor group 71 and the differential signal of the second sensor group 72.

There is also a delay time sign determining unit 78 for determining the sign of the delay time of the first sensor group 71 based on the combination of the sign of the difference signal of the first sensor group 71 and the sign of the differential signal of the first sensor group 71 and the positional relationship of the sensors of the first sensor group 71, and for determining the sign of the delay time of the second sensor group 72 based on the combination of the sign of the difference signal of the second sensor group 72 and the sign of the differential signal of the second sensor group 72 and the positional relationship of the sensors of the second sensor group 72. The signs of the delay time are determined with reference to the criteria shown in Table 1.

With the above configuration, the direction of a sound source can be estimated in a more narrow range than when there is a single sensor group.

It should be noted that the sensor groups do not necessarily have to be arranged as shown in FIG. 8, and the sensor groups can assume any arrangement as long as the apertures of each sensor group cross one another, even if they do not share a sensor.

Figure 9:
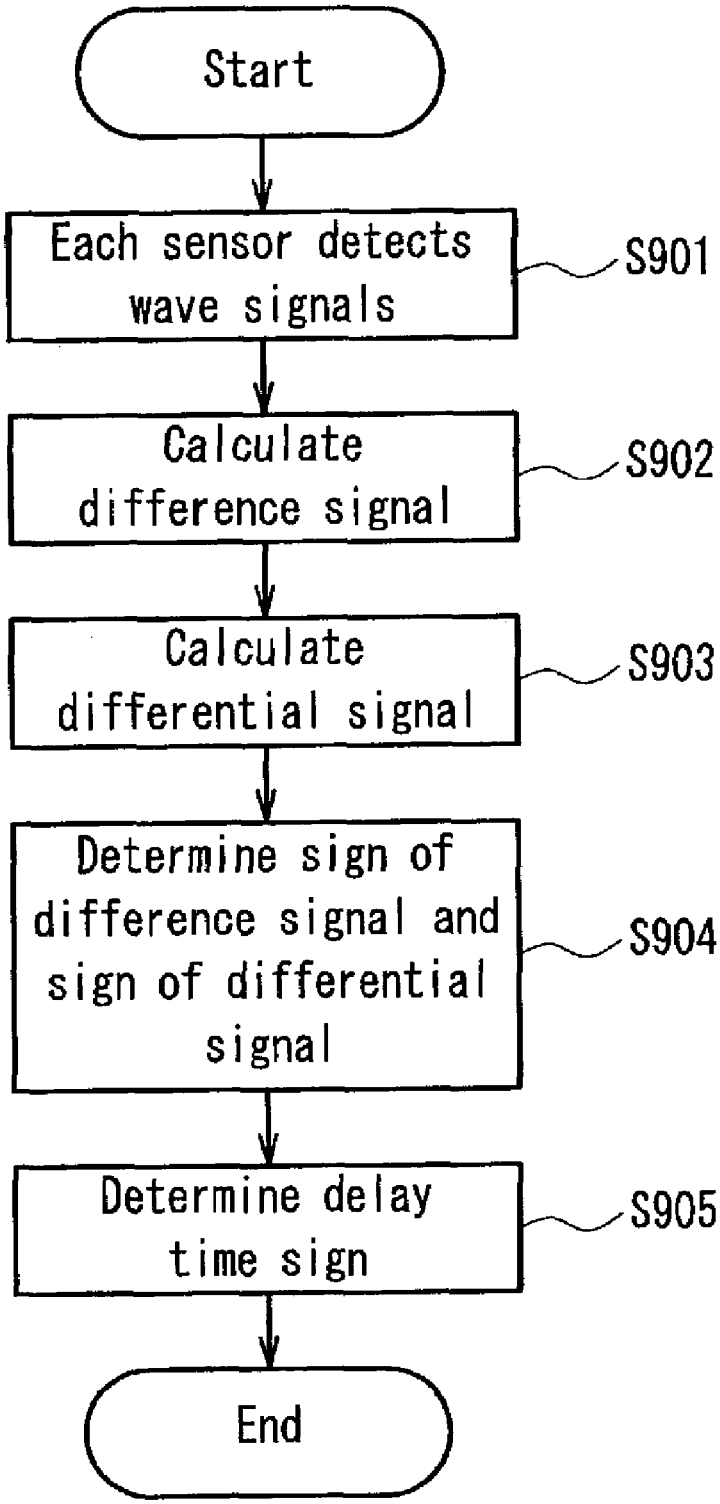
FIG. 9 is a flow diagram illustrating the processing of the wave signal processing system of the Embodiment 1 according to the present invention.

The following is a description of the flow diagram illustrating the processing of a program for achieving the wave signal processing system of the Embodiment 1 according to the present invention. FIG. 9 shows the flow diagram illustrating the processing of the program for achieving the wave signal system of an embodiment according to the present invention.

In FIG. 9, first, each sensor detects the wave signal (operation 901), and the wave signal that is detected by one sensor is subtracted from the wave signal that is detected by the other sensor and this difference signal is output (operation 902).

Then, a differential signal is calculated for the wave signal detected by at least one of the sensors of the sensor group, and the result is output (operation 903).

Next, the sign of the difference signal and the sign of the differential signal of the sensor group are determined (operation 904), and the sign of the delay time of the sensor group is determined based on the combination of the sign of the difference signal and the sign of the differential signal and the positional relationship of the sensors (operation 905).

Thus, according to Embodiment 1, the sign of the delay time can be determined simply by comparing the signs of the difference signal and the differential signal, and thus the calculation load can be reduced compared to conventional methods for determining the delay time using correlation calculation and extracting its sign.

Also, due to the fact that a Taylor expansion approximation (Equation 2) is used under the assumption that the delay time $\Delta t$ is infinitesimal, accurate results can be obtained more stably than in the case of a conventional method in which correlation calculation is carried out to determine the sign of the delay time, even in the case of a compact portable device, for example, in which only a sensor arrangement with a small aperture is possible and only a very small delay time can be detected.

Furthermore, the difference calculations, the differential calculations, and the comparison of the signs of the signals can be achieved by using a difference circuit, a differential circuit, and a comparator, respectively, configured by operational amplifiers. Compared to conventional methods that for correlation calculation require an expensive A/D conversion chip with a high sampling rate and a general purpose processor or a DSP, the present invention is superior not only in terms of cost but also in terms of the simplicity of the system configuration.

Figure 10:
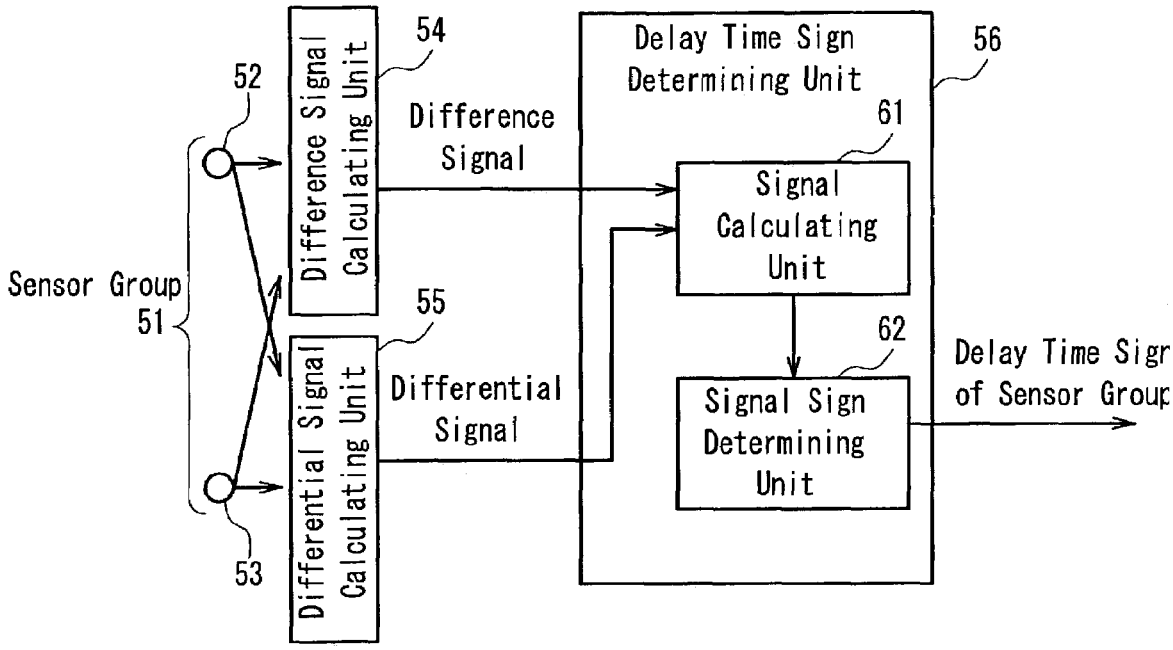
FIG. 10 is a block diagram showing the configuration of the delay time sign determining unit of the wave signal processing system of an Embodiment 1 according to the present invention.

In Embodiment 1, various configurations are conceivable for the delay time sign determining unit 56. For example, FIG. 10 is a block diagram of the delay time sign determining unit 56 in the wave signal processing system of an Embodiment 1 according to the present invention. As shown in FIG. 10, the delay time sign determining unit 56 is provided with a signal calculating unit 61 and a signal sign determining unit 62.

First, the signal calculating unit 61 either multiplies or divides the difference signal by the differential signal and outputs the result as a multiplied signal or a divided signal. The signal sign determining unit 62 extracts the sign of the multiplied signal or the divided signal that is output from the signal calculating unit 61, and outputs only that sign.

Figure 11:
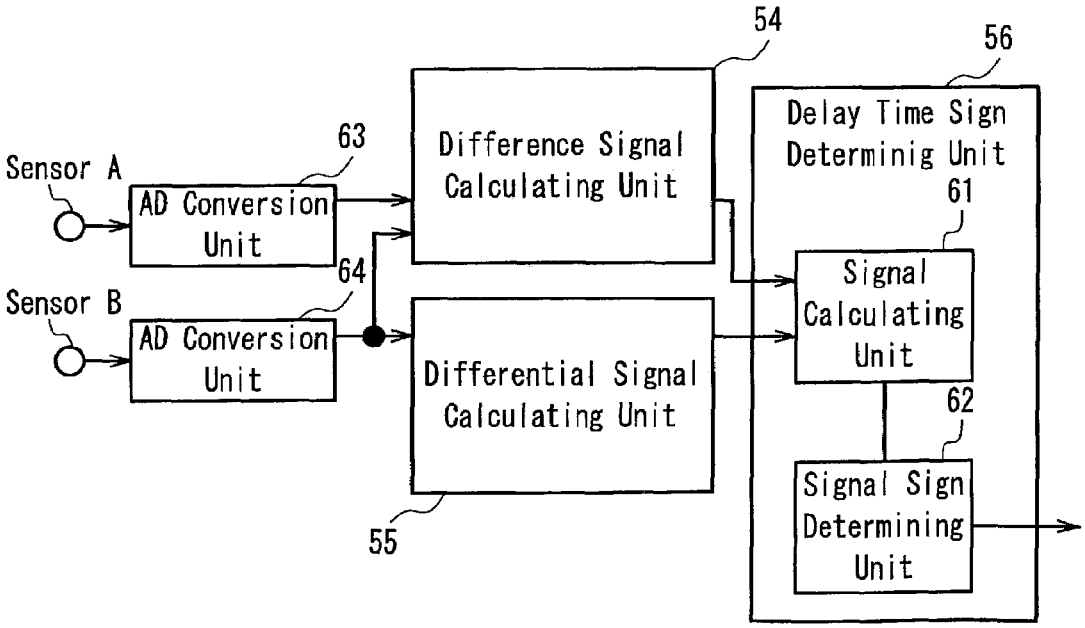
FIG. 11 is a specific example showing the delay time sign determining unit of the wave signal processing system of the Embodiment 1 according to the present invention.

More specifically, FIG. 11 shows an example configuration in which DSPs or general purpose processors are used. In FIG. 11, the difference signal calculating unit 54, the differential signal calculating unit 55, and the delay time sign determining unit 56 are achieved by general purpose processors. It should be noted that for the purpose of distinguishing the two sensors, the sensor 52 and the sensor 53 are labeled as sensor A and sensor B for convenience.

As shown in FIG. 11, A/D conversion units 63 and 64 perform A/D conversion of the wave signals detected by the sensors A and B and output discrete digital data sequences $f_A(k)$ and $f_B(k)$ (k=0, 1, 2, 3, . . .). Additionally, the difference signal calculating unit 54 calculates a difference signal $g_{Sub}(k)$, where $g_{Sub}(k)=f_B(k)-f_A(k)$, and outputs it. Similarly, the differential signal calculating unit 55 calculates the slope between the two samples, $(f_A(k)-f_A(k-1))/T$, from the present input signal $f_A(k)$ and the previous input signal $f_A(k-1)$, and takes that slope approximately as a differential signal $g_{Diff}(k)$. Here, T represents the sampling period of the A/D conversion units 63 and 64. The A/D conversion units 63 and 64 must perform sampling in synchronization. If they are not in synchronization, it is necessary to interpolate one of the data sets and synchronize it with the other data set. Lastly, the signal calculating unit 61 either multiplies or divides the difference signal $g_{Sub}(k)$ and the differential signal $g_{Diff}(k)$, and based on this result, the signal sign determining unit 62 extracts the sign.

Of course, the signal sign determining unit 62 can be provided with a difference signal sign determining unit (not shown) for extracting the sign of the difference signal and a differential signal extracting unit (not shown) for extracting the sign of the differential signal, in order to determine the sign of the delay time by processing only signs.

Figure 12:
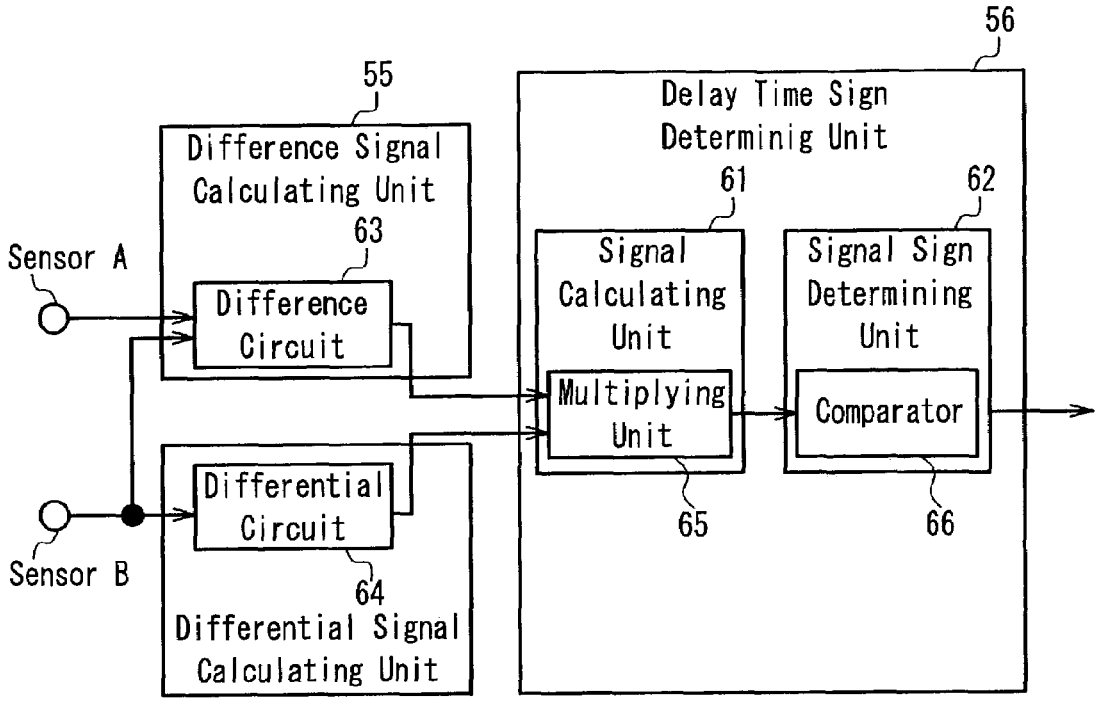
FIG. 12 is another specific example showing the delay time sign determining unit of the wave signal processing system of the Embodiment 1 according to the present invention.

On the other hand, a configuration is possible in which processors are not used. In this case, as shown in FIG. 12, the wave signals that are detected by the sensors A and B are input directly to a difference circuit 63 and a differentiating circuit 64 configured by operational amplifiers, and a difference signal and a differential signal of the signals are output. Then, the signals are multiplied using a multiplying circuit 65, and the positive or negative output of the multiplier circuit 65 is detected by a comparator 66.

Likewise, it is also possible not to input to the multiplier circuit 65 the difference signal and the differential signal that are output, but to detect the signs of the signals with a comparator and then use a half-adder to determine the sign of the delay time.

By adopting this configuration, the wave signal processing system of the Embodiment 1 can be easily achieved with a digital circuit that uses processors or an analog circuit that uses operational amplifiers.

That is, with a configuration in which a digital circuit that uses processors is adopted, the sign of the delay time is determined based on the sign of the multiplied signal of the difference signal and the differential signal, and thus compared to conventional methods for calculating the delay time using correlation calculation and extracting its sign, the processing can be performed with fewer operations.

Also, a configuration in which an analog circuit is adopted is superior in terms of cost and the simplicity of the system configuration compared to conventional methods that for correlation calculation require an expensive A/D conversion chip with a high sampling rate and a general purpose processor or a DSP.

Embodiment 2

Figure 13:
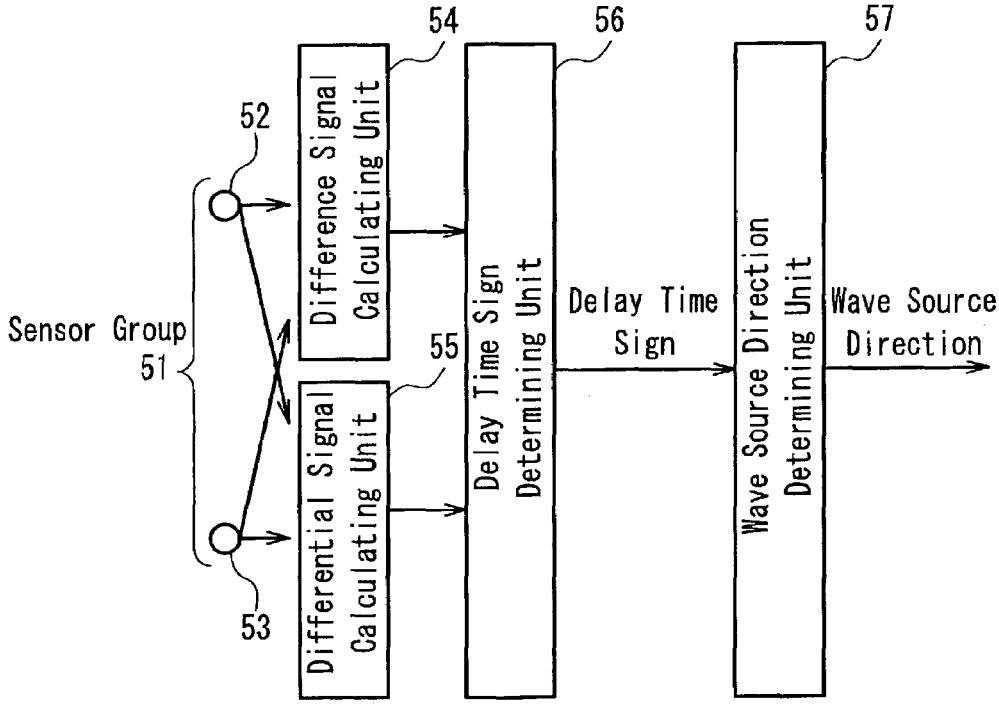
FIG. 13 is a block diagram showing the configuration of the wave signal processing system of an Embodiment 2 according to the present invention.

FIG. 13 is a block diagram showing the configuration of the wave signal processing system of an Embodiment 2 according to the present invention. As shown in FIG. 13, in Embodiment 2, a wave source direction determining unit 57 has been added to the wave signal processing system of the Embodiment 1.

That is, the wave source direction determining unit 57 determines the direction of a wave source based on the sign of the delay time that is output from the delay time sign determining unit 56 at the previous stage.

The procedure for determining the direction of the wave source is explained with reference to the sensor arrangement of FIG. 1. In FIG. 1, in order to distinguish the two sensors of the sensor group, the sensors have been assigned identifiers A and B for the sake of convenience. Here, the difference signal calculating unit 54 subtracts the wave signal that is detected by the sensor A from the wave signal that is detected by the sensor B, and outputs a difference signal.

At this time, when a wave signal is incident from the sensor A side of the branching plane, the wave signal that is detected by the sensor B lags behind the wave signal that is output by the sensor A, and thus the sign of the delay time is negative according to Table 1.

On the other hand, when a wave signal is incident from the sensor B side of the branching plane, the wave signal that is detected by the sensor B is ahead of the wave signal that is detected by the sensor A, and thus the sign of the delay time is positive according to Table 1.

Consequently, the wave source direction determining unit 57 can determine that the wave source is on the sensor A side of the branching plane if the output of the delay time sign determining unit 56 at the previous stage is negative and can determine that the wave source is on the sensor B side of the branching plane if the output is positive, and can output which direction of the branching plane the wave source is on (if the output is "0," the wave source is on the branching plane).

For example, if the sign of the delay time is negative, the space on the sensor A side of the branching plane in FIG. 1, that is, the direction from 0 to 180 degrees, is output as the direction in which the wave source is located.

It should be noted that Embodiment 2 has been described with regard to one sensor group, but like Embodiment 1, there are no particular limitations to the number of sensor groups, as long as when there are two or more sensor groups they are arranged so that their apertures intersect one another. Also, there are no particular limitations to the number of sensors in the sensor groups, and there may be three or more sensors in a sensor group.

Also, it is not absolutely necessary that the sensor groups are arranged as shown in FIG. 1, and as long as the apertures of the sensor groups intersect one another, the sensors A and B can be disposed in any arrangement.

Further, it is also possible to determine the difference signal with the difference signal calculating unit 54 by subtracting the wave signal that is detected by the sensor B from the wave signal that is detected by the sensor A. However, in this case, the result that is determined by the wave source direction determining unit 57 must be interpreted as its opposite. That is, if the output of the delay time sign determining unit 56 at the previous stage is negative, then the wave source must be determined to be on the sensor B side of the branching plane, and if its sign is positive, then the wave source must be determined to be on the sensor A side of the branching plane.

Thus, according to Embodiment 2, the direction of a wave source is determined using the sign of the delay time, which is determined using a simple calculation for comparing the sign of the difference signal and the sign of the differential signal, and thus, compared to conventional methods in which correlation calculation is employed to calculate the delay time and based on this delay time the direction of the wave source is calculated, it is possible to achieve a reduction in the number of required operations.

Also, because the approximation of the Taylor expansion (Equation 2) is derived under the assumption that the delay time $\Delta t$ is infinitesimal, accurate results can be obtained more stably than in the case of a method in which conventional correlation calculation is carried out to determine the sign of the delay time, even in the case of a compact portable device, for example, in which the only possible sensor arrangement has a small aperture capable of detecting only a very small delay time.

Furthermore, the difference calculations, the differential calculations, and the comparison of the signs of the signals can be achieved by using a difference circuit, a differential circuit, and a comparator, respectively, configured by operational amplifiers. Compared to conventional methods that for correlation calculation require an expensive A/D conversion chip with a high sampling rate and a general purpose processor or a DSP, the present embodiment is superior not only in terms of cost but also in terms of the simplicity of the system configuration.

Embodiment 3

Figure 14:
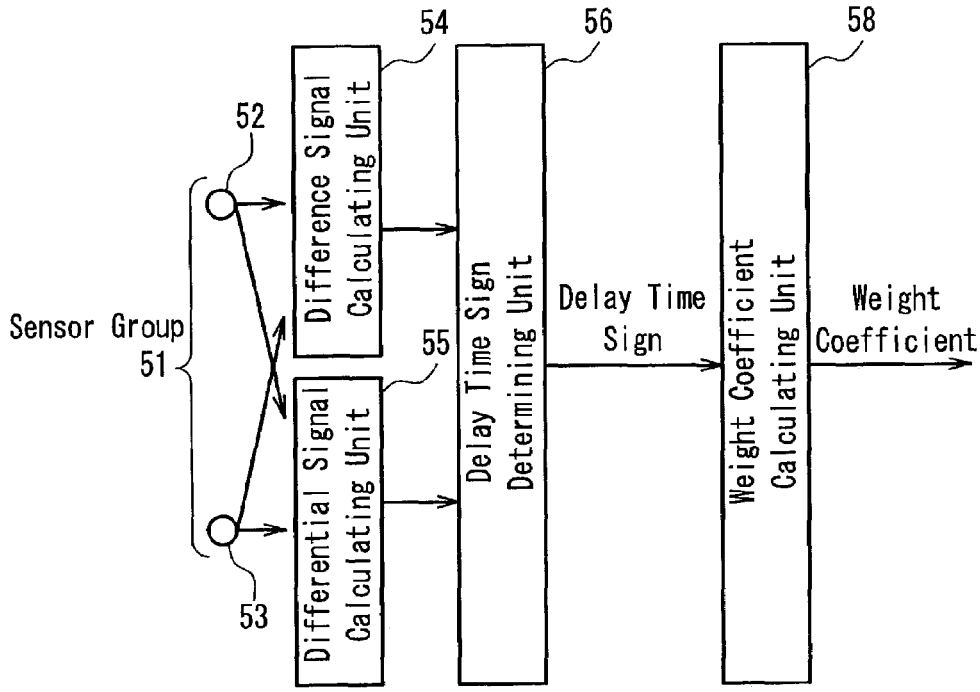
FIG. 14 is a block diagram showing the configuration of the wave signal processing system of an Embodiment 3 according to the present invention.

FIG. 14 is a block diagram showing the configuration of the wave signal processing system of an Embodiment 3 according to the present invention. As shown in FIG. 14, in Embodiment 3, a weight coefficient calculating unit 58 has been added to Embodiment 1. The weight coefficient calculating unit 58 is descried below.

In the sensor arrangement shown in FIG. 1, for example, seen from the branching plane, the weight of the wave signal from the direction of the space 1 can be taken as $\alpha$ and the weight of the wave signal from the direction of space 2 can be taken as $\beta$. Then, if the relationship between the spaces and the sign of the delay time was theoretically derived from the positional arrangement of the sensors, then from Equation 1 the delay time sign is negative if the wave signal is incident from the space 1 and the delay time sign is positive if the wave signal is incident from the space 2. Consequently, if the sign of the delay time is negative, then a weight of $\alpha$ is output, and if positive, then a weight of $\beta$ is output. Here, the difference signal calculating unit 54 calculates the difference signal by subtracting the wave signal that is detected by the sensor A from the wave signal that is detected by the sensor B.

It should be noted that Embodiment 3 has been described with regard to one sensor group, but there are no particular limitations to this, and there can be two or more sensor groups as long as they are arranged so that their apertures intersect one another. Also, there are no particular limitations to the number of sensors in the sensor groups, and there may be three or more sensors in a sensor group.

Also, it is not absolutely necessary that the sensor groups are arranged as shown in FIG. 1, and as long as the apertures of the sensor groups intersect one another, the sensors A and B can be disposed in any arrangement.

Furthermore, the difference signal calculating unit 54 can also calculate the difference signal by subtracting the wave signal that is detected by sensor B from the wave signal that is detected by sensor A. However, in this case, the output of $\alpha$ and $\beta$ with respect to whether the sign of the delay time is positive or negative must obviously be inverted by the weight coefficient calculating unit 58.

Thus, according to Embodiment 3, the weight coefficient is determined using the sign of the delay time, which is determined using a simple operation for comparing the sign of the difference signal and the sign of the differential signal, and thus compared to methods in which conventional correlation calculation is employed to calculate the delay time and based on this delay time the weight coefficient is calculated, it is possible to achieve a reduction in the number of required operations.

Also, because an approximation of the Taylor expansion (Equation 2) is derived under the assumption that the delay time $\Delta t$ is infinitesimal, accurate results can be obtained more stably and accurately than in the case of a method in which conventional correlation calculation is carried out to determine the sign of the delay time, even in the case of a compact portable device, for example, in which the only possible sensor arrangement has a small aperture capable of detecting only a very small delay time.

Furthermore, the difference calculations, the differential calculations, and the comparison of the signs of the signals can be achieved by using a difference circuit, a differential circuit, and a comparator, respectively, configured by operational amplifiers. Compared to conventional methods that for correlation calculation require an expensive A/D conversion chip with a high sampling rate and a general purpose processor or a DSP, the present embodiment is superior not only in terms of cost but also in terms of the simplicity of the system configuration.

Also, by combining this configuration with that of Embodiment 2, that is, by detecting the weight coefficient with the weight coefficient calculating unit 58 after determining the direction of the wave source with the wave source direction determining unit 57, the weight coefficient for suppressing noise, which is described later, can be determined with few operations.

Embodiment 4

Figure 15:
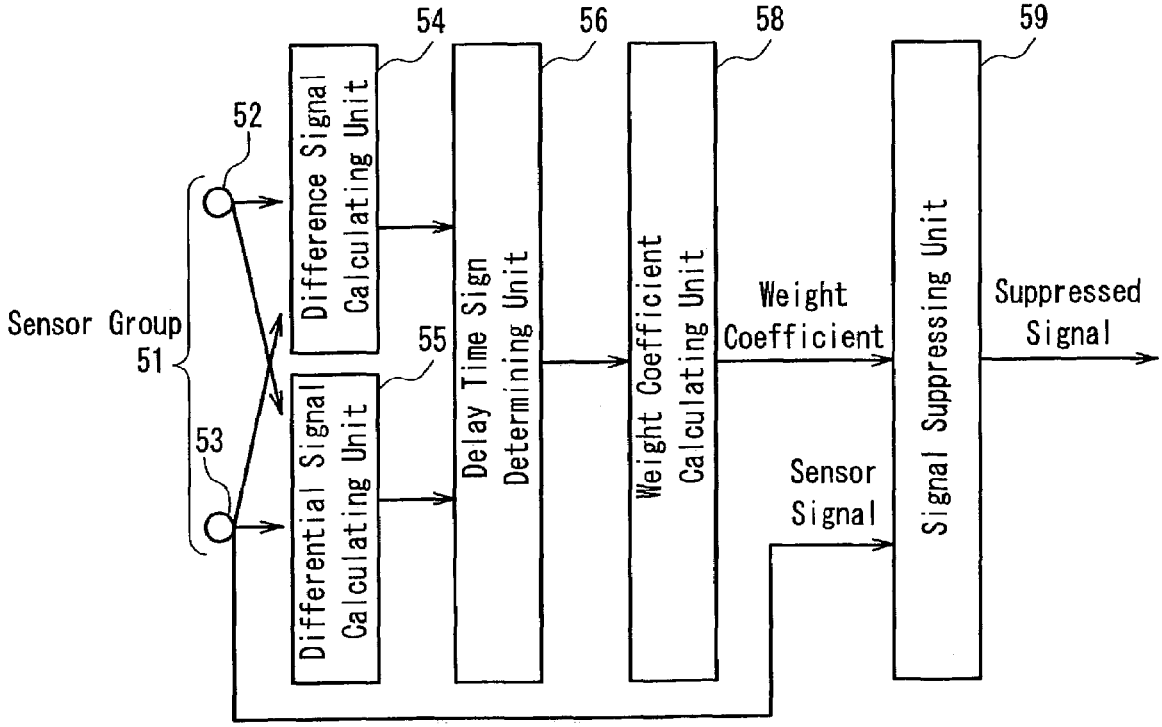
FIG. 15 is a block diagram showing the configuration of the wave signal processing system of an Embodiment 4 according to the present invention.

FIG. 15 is a block diagram showing the configuration of the wave source signal processing system of an Embodiment 4 according to the present invention. As shown in FIG. 15, in Embodiment 4, a signal suppressing unit 59 has been added to the wave source signal processing system according to Embodiment 3 shown in FIG. 14.

The signal suppressing unit 59 is provided with an input unit for receiving the wave signal that is detected by one sensor, and based on the weight coefficient that is output from the weight coefficient calculating unit 58, it assigns a weight to the wave signal that is received by its input unit and outputs it. It should be noted that it is only necessary that the weight coefficient calculating unit 58 is arranged immediately before the signal suppressing unit 59, and thus the configuration can also include the wave signal direction determining unit 57 in a combination of the configuration of Embodiment 2 and the configuration of Embodiment 3.

Thus, with a configuration in which one sensor group is used, it is possible to completely eliminate directivity in the rear plane of the branching plane of the sensors and achieve stronger directivity than conventional unidirectional microphones, with which directivity remains in the rear plane direction.

Also, even with a configuration in which a plurality (two or more) of sensor groups are employed, sharper directivity with a more compact configuration than conventional gun microphones and microphone arrays can be attained.

Embodiment 5

Figure 16:
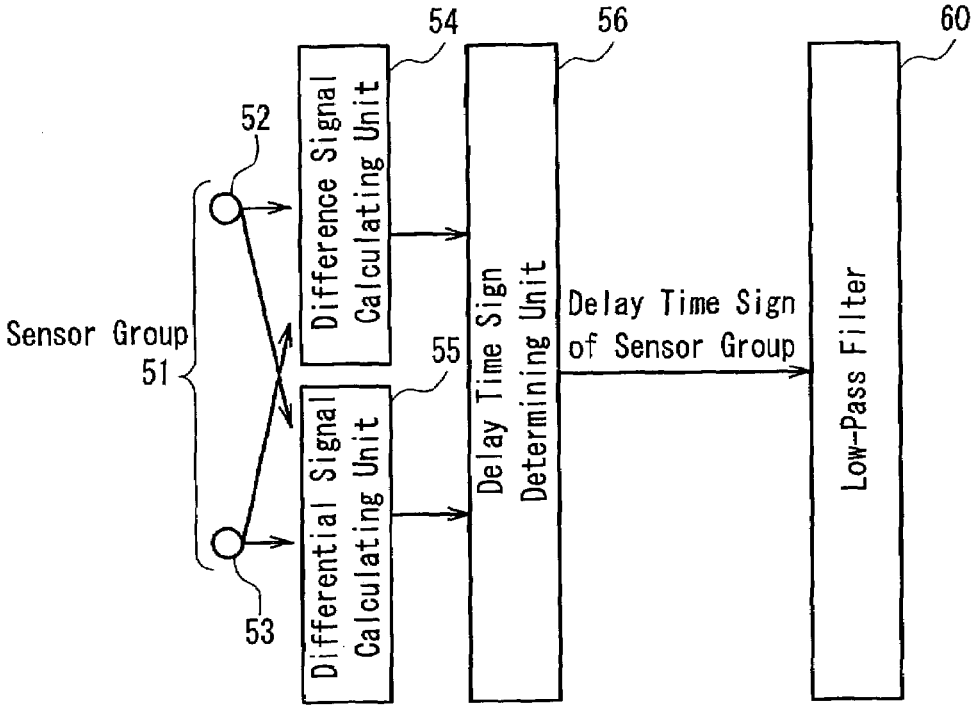
FIG. 16 is a block diagram showing the configuration of the wave signal processing system of an Embodiment 5 according to the present invention.

FIG. 16 is a block diagram showing the configuration of the wave signal processing system of an Embodiment 5 according to the present invention. In Embodiment 5, a low-pass filter 60 has been added in a stage subsequent to the delay time sign determining unit 56.

The low-pass filter 60 has been added for the purpose of removing periods like the time period Q shown in FIG. 2 in which errors in sign determination occur. As for the filter, it can be a commonly known low-pass filter made of a capacitor and a resistor, an active filter that employs an operational amplifier, or in a case where the configuration includes a processor, a finite impulse response (FIR) filter or an infinite impulse response (IIR) filter, for example.

By providing the low-pass filter 60 as above, accurate results can always be obtained when the sign of the delay time is determined, and the sign of the delay time can be determined with higher precision than methods in which conventional correlation calculation is employed to determine the sign of the delay time, even if the calculating processing device is compact or has limited calculating ability.

Figure 17:
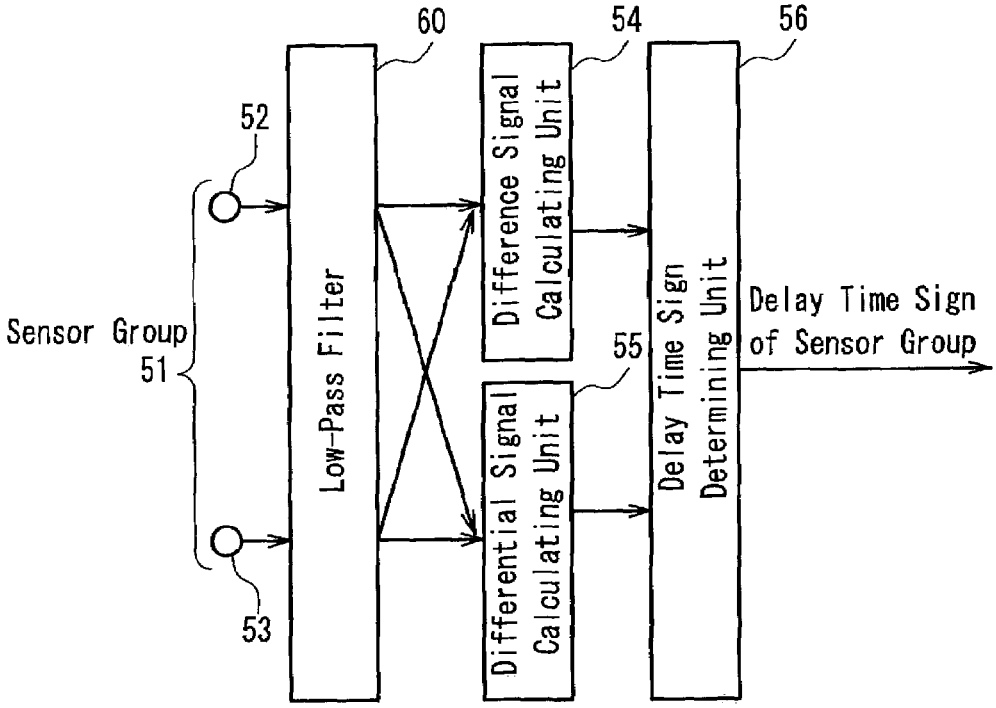
FIG. 17 is a block diagram showing another configuration of the wave signal processing system of the Embodiment 5 according to the present invention.

It is also conceivable to position the low-pass filter 60 immediately after the sensors 52 and 53. This configuration is shown in the block diagram of FIG. 17.

Figure 18A:
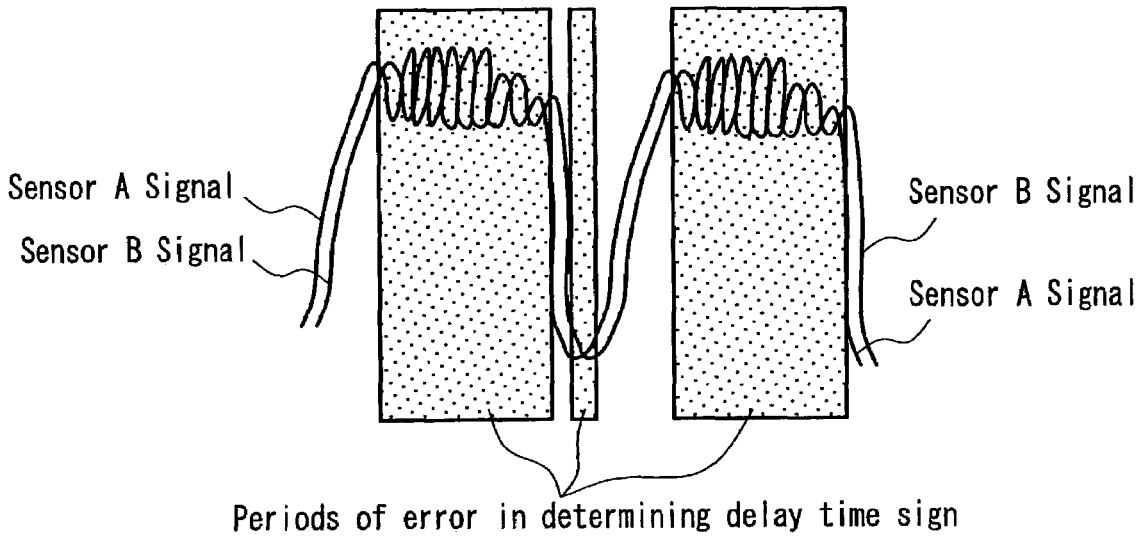
FIG. 18 is a diagram showing the results of the low-pass filter in the wave signal processing system according to the present invention.
Figure 18A:
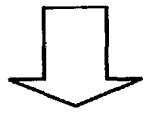

With the method for determining the sign of the delay time according to the present invention, there will always be periods during which there are errors in the sign determination, such as the time period Q shown in FIG. 2. For example, if audio signals with mixed low and high frequencies like those shown in FIG. 18A are received, then the periods including the high frequency waves include numerous states like that shown at the time period Q and have many periods in which the delay time cannot be determined accurately.

Figure 18B:
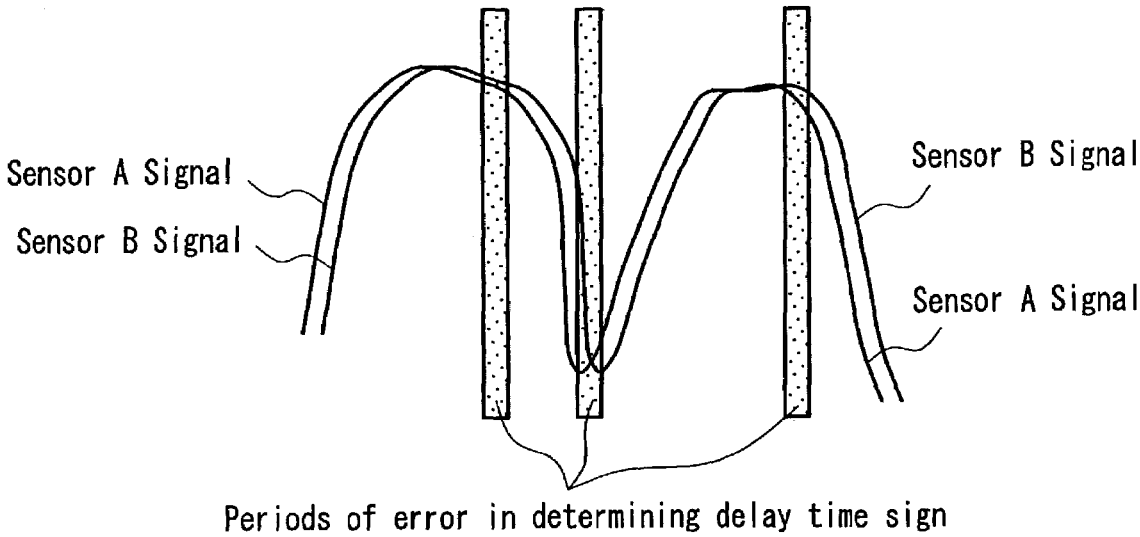

For that reason, by passing the input signals through a low-pass filter so as to carry out signal processing with a waveform in which only the low frequency component remains, such as the waveform shown in FIG. 18B, it becomes possible to reduce the periods during which miscalculations occur. As for the configuration of the filter, it is possible to use a commonly known analog filter made of a capacitor and a resistor, an active filter that employs an operational amplifier, or in a case where the system configuration is digital, a finite impulse response (FIR) filter or an infinite impulse response (IIR) filter, for example.

Thus, with a configuration in which the low-pass filter 60 is arranged immediately after the sensors, errors in determining the sign of the delay time due to the high frequency component can be reduced, and the sign of the delay time can be determined with higher precision than through methods in which conventional correlation calculation is employed to determine the sign of the delay time, even with compact configurations.

Embodiment 6

Figure 19:
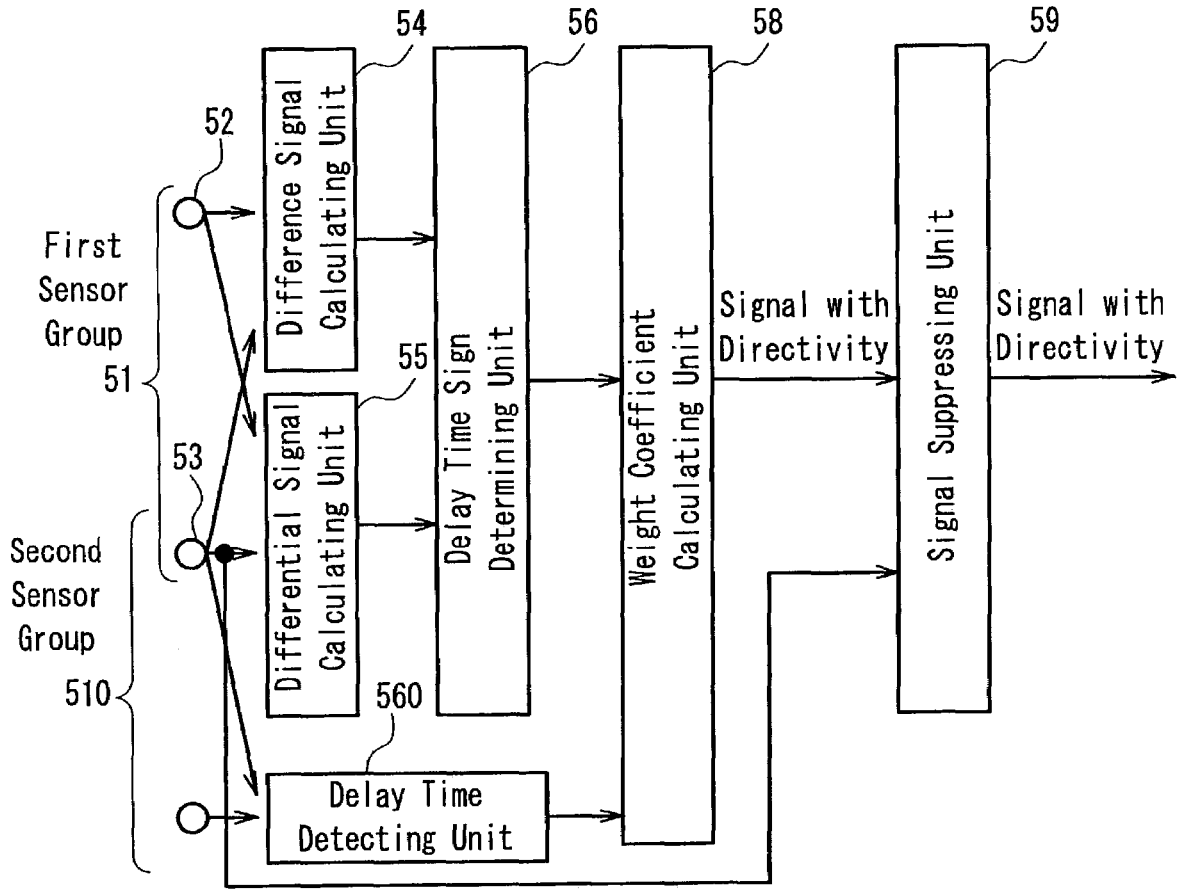
FIG. 19 is a block diagram showing the configuration of the wave signal processing system of an Embodiment 6 according to the present invention.

FIG. 19 is a block diagram showing the configuration of the wave signal processing system of an Embodiment 6 according to the present invention. In Embodiment 6, in addition to the sensor group 51, a second sensor group 510 and a delay time calculating unit 560 have been added. The output of the delay time calculating unit 560 is received by the weight coefficient calculating unit 58, and the sensor signal of the second sensor group 510 is also received by the signal suppressing unit 59.

The delay time calculating unit 560 outputs the delay time of the signal that arrives at the two sensors of the second sensor group 510. The means for detecting the delay time can be a method that employs cross-correlation or a method such as that disclosed in Japanese Patent Application No. 2002-078697, in which the difference signal is divided by the differential signal.

The weight coefficient calculating unit 58 sets the weight coefficient to '1' or less if the sign of the delay time that is obtained from the sensor group 51 (first sensor group) and the delay time that is obtained from the second sensor group 510 do not match the delay time and the sign of the delay time that occur if a sound wave arrives from the target wave source direction, and the signal suppressing unit 59 suppresses by its weight coefficient (be weighting) and outputs either the signal of the first sensor group or the second sensor group.

In addition, it is possible to provide a wave source direction detecting unit (not shown) after the delay time calculating unit 560 and to provide the wave source determining unit 57 after the delay time sign determining unit 56 and determine the weight coefficient from the information on the wave source direction. In this case, the weight coefficient is set to a value of '1' or less if a wave source direction other than the direction of the target wave source is detected. It should be noted that the first sensor group and the second sensor group do not necessarily have to share microphones, and can each be provided with their own microphones.

As described above, by providing a configuration that includes a second sensor group for detecting the delay time and a first sensor group for determining the sign of the delay time, unidirectivity can be achieved with fewer operations than in a case where directivity is created by calculating the delay times of the two sensor groups independently to determine a single sound source direction.

Figure 20:
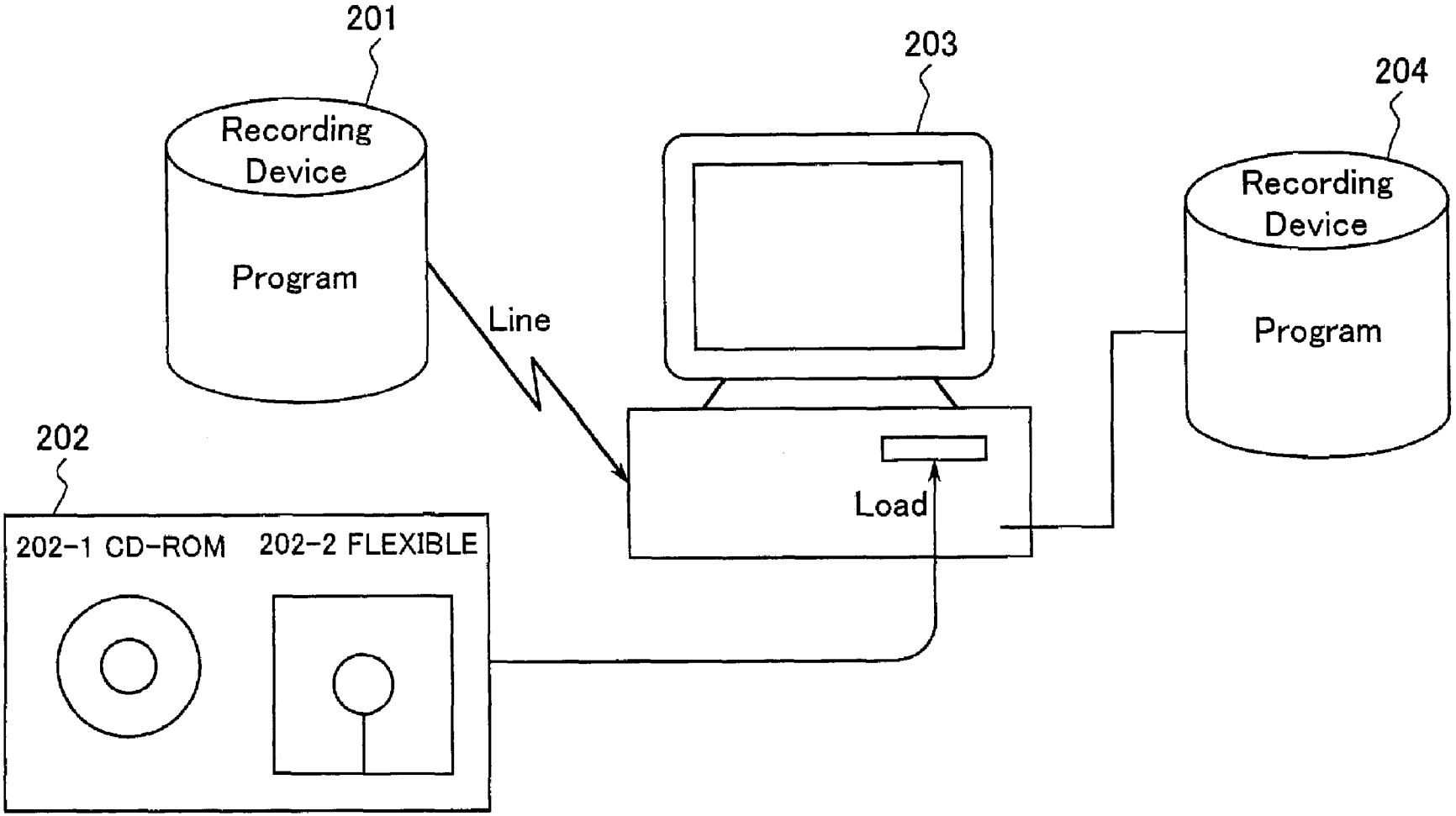
FIG. 20 is a view illustrating a computer environment.

As shown in FIG. 20, a program for achieving the wave signal processing system of embodiments according to the present invention can be stored on not only a portable recording medium 202 such as a CD-ROM 202-1 and a flexible disk 202-2 but also on another recording device 201 provided before the communications line or a recording medium 204 such as the hard disk or RAM of a computer 203. Also, when the program is executed, it is loaded and executed on the main memory.

Furthermore, as shown in FIG. 20, the difference signals and the differential signals created by the wave signal processing system of embodiments according to the present invention can be stored on not only the portable recording medium 202 such as the CD-ROM 202-1 and the flexible disk 202-2 but also on another recording device 201 provided before the communications line or the recording medium 204 such as the hard disk or RAM of the computer 203. For example, they can be read out by the computer 203 when the wave signal processing system according to the present invention is employed.

With the wave signal processing system according to the present invention, the direction of a wave source can be determined with precision even if a calculation processing device that is compact or has low computing power is used, and moreover, by using that information, a wave signal processing system having unidirectivity can be achieved even with a calculation processing device that is compact or has low computing power.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A wave signal processing system including at least one sensor group of at least two sensors, comprising:

a difference signal calculating unit calculating a difference signal between respective wave signals that are detected by any two sensors in the at least one sensor group;

a differential signal calculating unit calculating a differential signal of a wave signal that is detected by at least one sensor in the at least one sensor group; and a delay time sign determining unit determining, based on a positional relationship of the sensors and a combination of both a sign of the difference signal and a sign of the differential signal, a sign of a delay time between the wave signals that are detected by the two sensors, the sign of the delay time indicating whether the wave signals are leading or delayed with respect to each other.

2. The wave signal processing system according to claim 1, further comprising a wave source direction determining unit determining a direction of a wave source based on the sign of the delay time between the wave signals detected by at least one sensor group that is determined by the delay time sign determining unit and the positional relationship of the sensors.

3. The wave signal processing system according to claim 2, further comprising a weight coefficient calculating unit calculating a weight coefficient based on the positive or negative sign of the delay time between the wave signals detected by at least one sensor group that is determined by the delay time sign determining unit and the positional relationship of the sensors, or the wave source direction of the wave signal detected by at least one sensor group that is determined by the wave source direction determining unit.

4. The wave signal processing system according to claim 3, further comprising a signal suppressing unit that uses the weight coefficient to weight the wave signals detected by at least one sensor in order to suppress unnecessary wave signal components that arrive from a direction other than a target wave source direction.

5. The wave signal processing system according to claim 1, provided with at least two sensor groups each made of at least two sensors, and comprising:

a delay time calculating unit calculating the delay time of any two sensor signals of the at least one sensor group; and a unit carrying out wave signal processing, based on the delay time sign, in parallel.

6. The wave signal processing system according to claim 5, further comprising a wave source direction detecting unit detecting a direction of the wave source based on the calculated delay time.

7. The wave signal processing system according to claim 1, wherein the delay time sign determining unit further comprises:

a signal calculating unit multiplying or dividing the difference signal and the differential signal; and a signal sign determining unit determining a sign of the result of multiplying or dividing by the signal calculating unit.

8. The wave signal processing system according to claim 1, wherein the delay time sign determining unit further comprises:

a difference signal sign determination unit determining the sign of the difference signal;

a differential signal sign determining unit determining the sign of the differential signal; and a sign determining unit comparing the sign of the difference signal in the difference signal sign determining unit and the sign of the differential signal in the differential signal sign determining unit and determining as a result, a sign of the delay time.

9. The wave signal processing system according to claim 1, further comprising a low-pass filter through which the result determined by the delay time sign determining unit is passed.

10. The wave signal processing system according to claim 1, further comprising a low-pass filter in a stage after the sensor group.

11. A wave signal processing method employing at least one sensor group made of at least two sensors, the method comprising:

calculating a difference signal between respective wave signals that are detected by any two sensors of the at least one sensor group;

calculating a differential signal of a wave signal that is detected by at least one sensor in the at least sensor group; and determining a delay time sign based on a positional relationship of the sensors and a combination of both a sign of the difference signal and a sign of the differential signal, the delay time sign indicating whether the wave signals detected by the two sensors are leading or delayed with respect to each other.

12. A computer readable medium having a program stored therein to cause a computer, to execute operations including controlling the computer to perform a wave signal processing method employing at least one sensor group made of at least two sensors, said operations comprising:

calculating a difference signal between respective wave signals that are detected by any two sensors of the at least one sensor group;

calculating a differential signal of a wave signal that is detected by at least one sensor in the at least sensor group; and determining a delay time sign based on a positional relationship of the sensors and a combination of both a sign of the difference signal and a sign of the differential signal, the delay time sign indicating whether the wave signals detected by the two sensors are leading or delayed with respect to each other.

* * * * *